US007220169B2

(12) United States Patent
Hepworth

(10) Patent No.: US 7,220,169 B2
(45) Date of Patent: May 22, 2007

(54) SHARPENING APPARATUS

(75) Inventor: Paul Steabben Hepworth, Guildford (GB)

(73) Assignee: Turner Intellectual Property Limited, Staffordshire (GB)

( * ) Notice: Subject to any disclaimer, the term of this patent is extended or adjusted under 35 U.S.C. 154(b) by 0 days.

(21) Appl. No.: 10/524,222

(22) PCT Filed: Aug. 7, 2003

(86) PCT No.: PCT/GB03/03453

§ 371 (c)(1),
(2), (4) Date: Aug. 4, 2005

(87) PCT Pub. No.: WO2004/014605

PCT Pub. Date: Feb. 19, 2004

(65) Prior Publication Data

US 2006/0154576 A1 Jul. 13, 2006

(30) Foreign Application Priority Data

Aug. 9, 2002 (GB) ..... 0218543.7

(51) Int. Cl.
*B25B 1/00* (2006.01)
*B25B 3/00* (2006.01)

(52) U.S. Cl. ..... 451/45; 451/229; 451/192; 451/193; 451/196; 451/202; 451/203; 451/208; 451/224; 451/234; 451/248; 451/293; 451/419; 451/555; 451/556

(58) Field of Classification Search ..... 451/45, 451/185, 187, 192, 193, 196, 221, 229, 202, 451/203, 205, 206, 208, 224, 234, 248, 263, 451/293, 321, 419, 555, 556
See application file for complete search history.

(56) References Cited

U.S. PATENT DOCUMENTS 1,143,383 A 6/1915 Green (Continued)

FOREIGN PATENT DOCUMENTS

EP 0 225 806 6/1987

(Continued)

*Primary Examiner*—Joseph J. Hall, III
*Assistant Examiner*—Robert Scruggs
(74) *Attorney, Agent, or Firm*—Nikolai & Mersereau, P.A.; C. G. Mersereau

(57) ABSTRACT

A sharpening apparatus (16) for a blade-like cutting implement. The sharpening apparatus has an elongate body (18) and a cutting edge extending widthwise across one end of the body (11) at a predetermined angle relative to the longitudinal axis of the body (11). The cutting edge is formed by an inclined face formed on one side face of the body. The apparatus includes a cradle (26) for holding a blade-like implement to be sharpened and a mounting body for mounting the cradle (26) relative to a grinding surface. The cradle is mounted on a pair of guide rails (22, 24) for movement along a rectilinear path, the cradle including first and second rail followers slidably connected to a first and second of the guide rails respectively. The cradle (26) includes a seat for locating the blade-like implement at a reselected reference position on the cradle (26) such that the cutting edge of the implement to be sharpened is located parallel to said rectilinear path. The first rail and/or the first rail follower is adjustably mounted to enable the lateral position of the rectilinear path to be adjusted.

8 Claims, 4 Drawing Sheets

U.S. PATENT DOCUMENTS

| | | | | | |
|---|---|---|---|---|---|
| 2,176,726 | A | * | 10/1939 | Shepherd | 451/410 |
| 2,724,931 | A | * | 11/1955 | Brandt et al. | 451/279 |
| 3,054,229 | A | * | 9/1962 | Peasley et al. | 451/273 |
| 4,052,174 | A | | 10/1977 | Grat | |
| 4,092,805 | A | * | 6/1978 | Williams | 451/202 |
| 4,259,814 | A | * | 4/1981 | Glaser et al. | 451/273 |
| 4,373,299 | A | * | 2/1983 | Gaston et al. | 451/273 |
| 5,218,787 | A | | 6/1993 | Rice | |
| 5,897,428 | A | | 4/1999 | Sakcriska | |
| 5,906,534 | A | | 5/1999 | Folkman et al. | |
| 5,944,592 | A | | 8/1999 | Hall et al. | |

FOREIGN PATENT DOCUMENTS

| | | | | |
|---|---|---|---|---|
| EP | 0471490 | B1 | | 1/1996 |
| FR | 615 617 | A | | 1/1927 |
| FR | 615617 | | * | 1/1927 |
| FR | 2621844 | A1 | | 10/1987 |

* cited by examiner

SHARPENING APPARATUS

This application is a continuation of International Application No. PCT/GB2003/03453, filed 7 Aug. 2003.

BACKGROUND OF THE INVENTION

The present invention relates to a sharpening apparatus for blade-like cutting implements and, in particular, to a sharpening apparatus for the sharpening of plane blades or chisels, as used in woodworking.

Generally plane blades or chisels have an elongate body and a cutting edge located at one end of the body.

The cutting edge is normally rectilinear, and is defined at the transition between an inclined face ground at a predetermined angle on one side face of the body, and the opposite face of the body.

The cutting edge normally extends across the width of the blade body at a predetermined angle, usually 90°, to the longitudinal axis of the elongate body.

It is desirable, when re-sharpening a plane blade or chisel, to re-grind the inclined face at the same angle as it was originally ground relative to said one side face, and also to grind along the inclined face such that the cutting edge extends across the width of the body at the said predetermined angle.

According to one aspect of the present invention there is provided a sharpening apparatus for a blade-like cutting implement having an elongate body and a cutting edge extending widthwise across one end of the body at a predetermined angle relative to the longitudinal axis of the body, the cutting edge being formed by an inclined face formed on one side face of the body, the apparatus including a cradle for holding a blade-like implement to be sharpened and a mounting body for mounting the cradle relative to a grinding surface, the cradle being mounted on a pair of guide rails for movement along a rectilinear path, the cradle including first and second rail followers slidably connected to a first and second of the guide rails respectively, the cradle including a seat for locating the blade-like implement at a preselected reference position on the cradle such that the cutting edge of the implement to be sharpened is located parallel to said rectilinear path, the first rail and/or the first rail follower being adjustably mounted to enable the lateral position of the rectilinear path to be adjusted.

Various aspects of the invention are hereinafter described with reference to the accompanying drawings in which.

Figure 1:
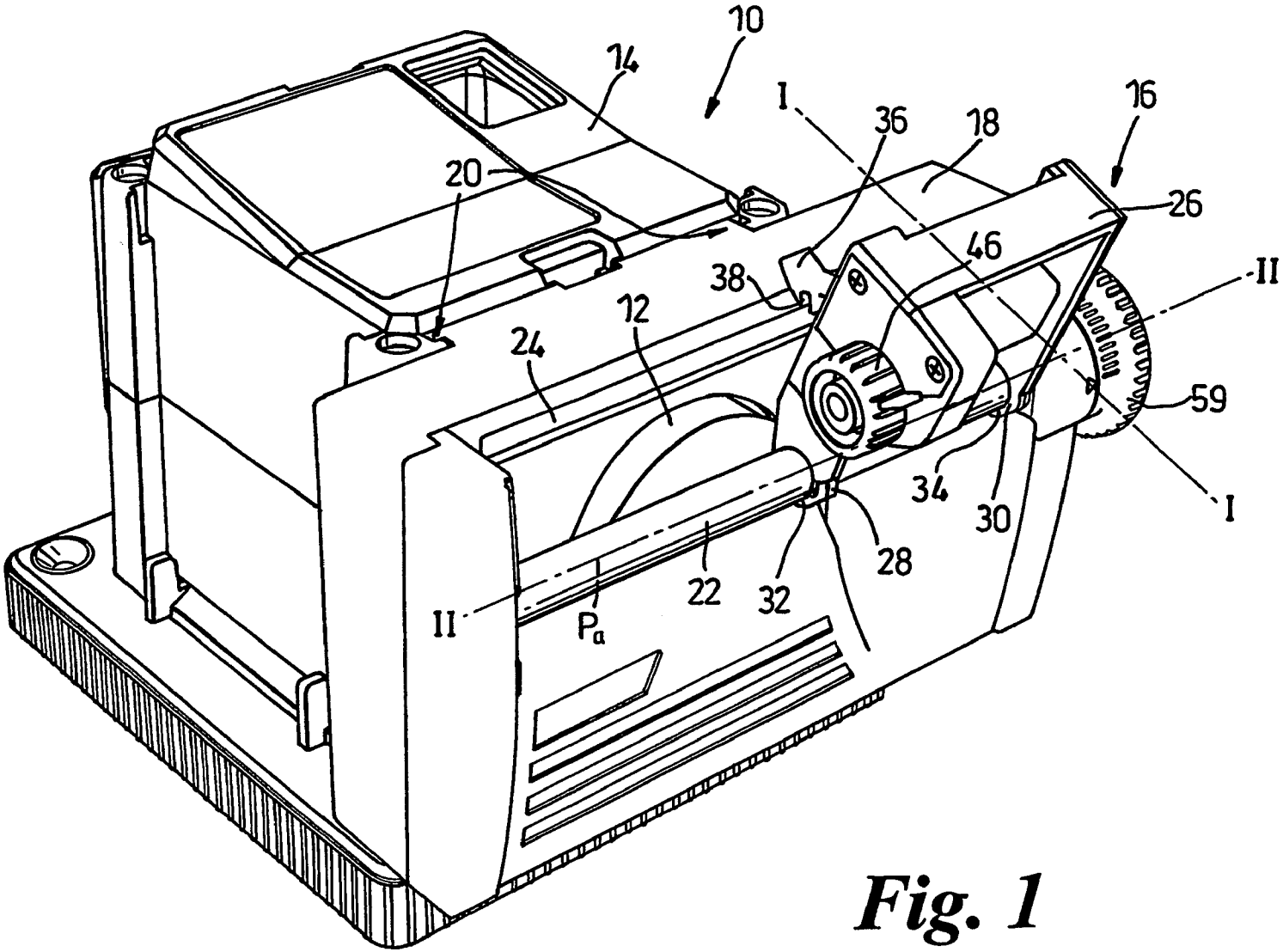
FIG. 1 is a perspective view of a sharpening device incorporating the sharpening apparatus according to an embodiment of the invention.

Referring initially to FIG. 1 there is shown a sharpening device 10 which includes a grinding wheel 12 mounted on the drive shaft of an electric motor housed within a housing 14.

A sharpening apparatus 16 is removably mounted on the housing 14. The attachment includes a mounting body 18 which is detachably attached to the housing 14 via a tongue and groove arrangement 20. The mounting body 18 includes a pair of generally parallel rails 22,24 that are spaced a predetermined distance apart, and extend widthwise of the mounting body 18 to define a rectilinear path.

The sharpening apparatus 16 also includes a cradle 26 slidably mounted on the rails 22,24 for movement along the rectilinear path.

A first 22 of the pair of rails is a rod-shaped member. The cradle 26 is slidably mounted thereon by means of first rail followers in the form of outwardly extending limbs 28,30 having apertures 32,34 therein through which the first rail 22 extends.

Figure 2:
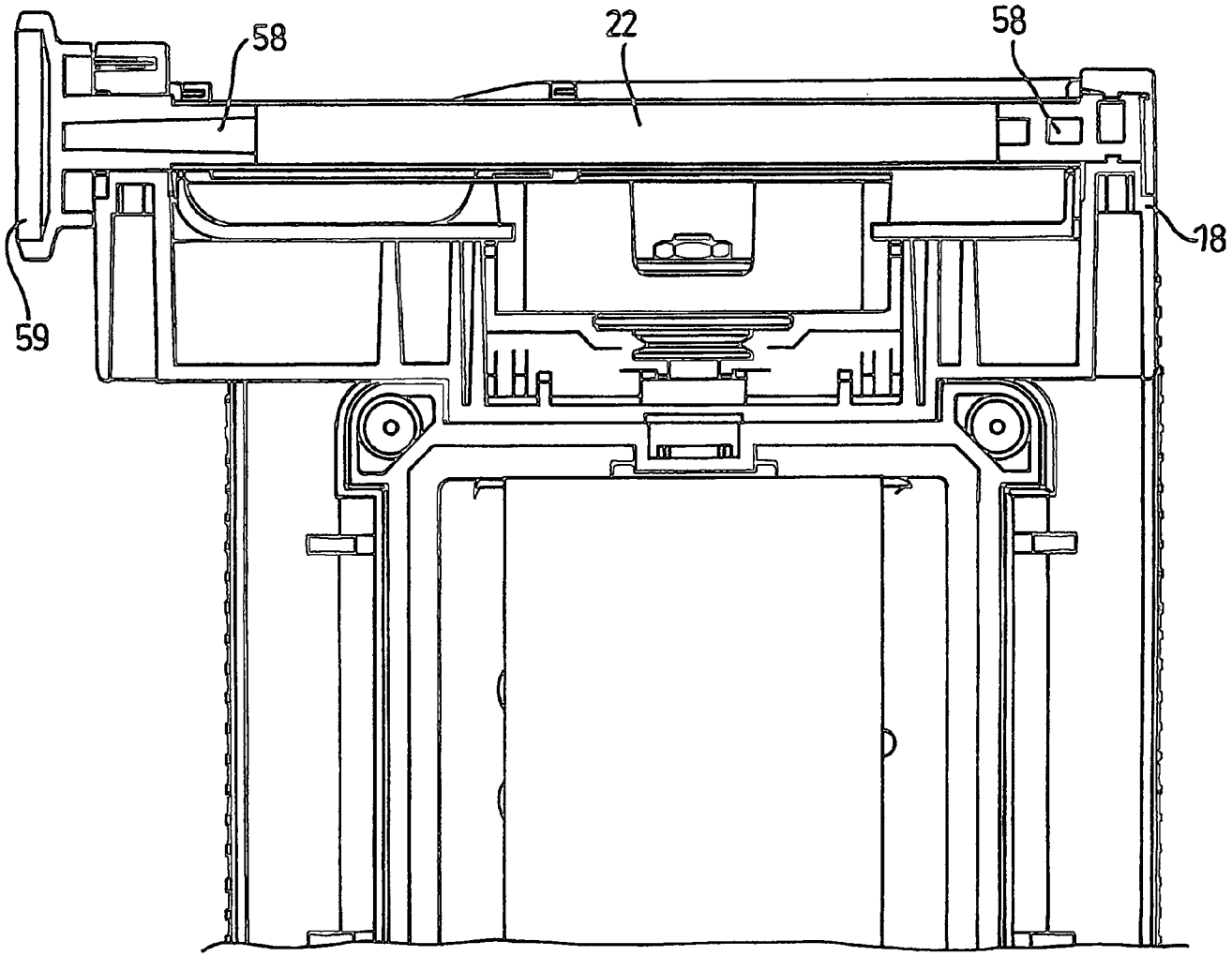
FIG. 2 is a partial cross-sectional view of the sharpening apparatus of FIG. 1 along the line I-I.

As shown in FIG. 2, the first rail 22 is preferably mounted at each end on an eccentric 58 rotatably supported in the mounting body 18. The eccentrics 58 thereby provide an adjustment means for adjusting the lateral position of the rectilinear path. An adjustment knob 59 is preferably connected to the eccentric 58 at one end of the first rail 22 to facilitate rotation of the first rail 22 and thereby adjustment of the lateral portion of the rectilinear path.

The second 24 of the pair of rails is formed as a flange and extends outwardly from the mounting body 18. The cradle 26 is slidably mounted on the second rail 24 by means of a second rail follower in the form of an outwardly extending arm 36. The arm 36 is connected to the cradle 26 at one end, and includes a recess 38 at its other end that is shaped to receive the second rail 24 therein.

Figure 3:
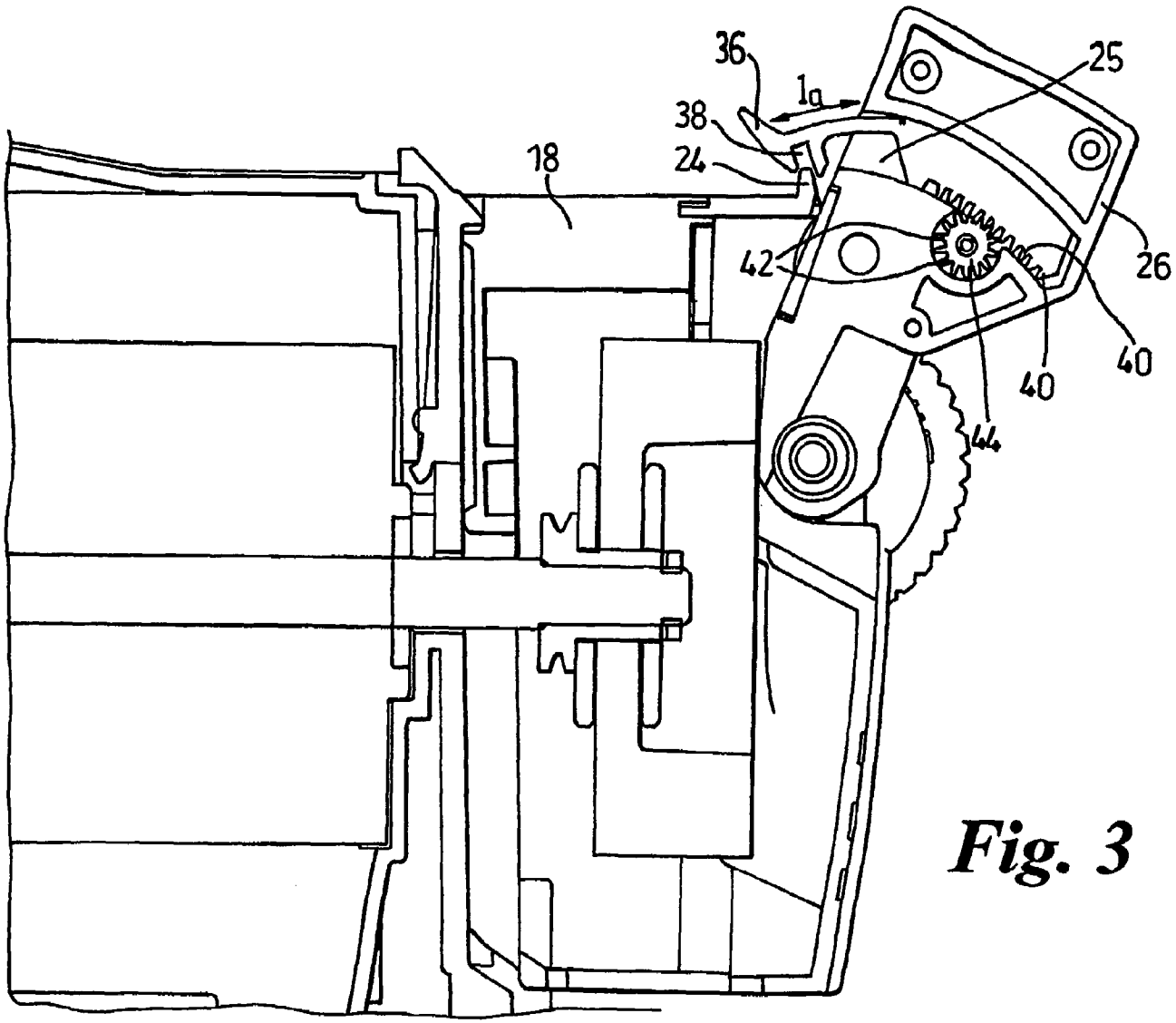
FIG. 3 is a partial cross-sectional view of the sharpening apparatus of FIG. 1 along the line II-II.

As shown in FIG. 3, the arm 36 is preferably received at its one end in a recess 25 formed in the cradle 26, and is preferably adjustably connected at its one end to the cradle 26 by means of a plurality of teeth 40 formed along an edge thereof and adapted to engage teeth 42 formed on a sprocket wheel 44 housed in the cradle 26.

The cradle 26 includes an adjustment knob 46 (FIG. 1) operably connected to the sprocket wheel 44 to facilitate adjustment of the angular position of the sprocket wheel 44 relative to the teeth 42 formed on the arm 36.

The separation between the cradle 26 and the second rail 24 is determined by the length $\mathbf{1}_a$ of the portion of arm 36 extending from the recess 25. The length of the arm 36 may be adjusted by turning the adjustment knob 46 such that engagement between the teeth 40 on the arm 36 and the teeth 42 on the sprocket wheel 44 drives the arm 36 into or out of the recess 25 formed in the cradle 26.

By adjusting the length $\mathbf{1}_a$ of the portion of arm 36 extending from recess 25, and thereby the separation between the cradle 26 and the second rail 24, the angular position of the cradle 26 may be adjusted about the longitudinal axis $P_a$ of the first rail 22.

In other embodiments, the angular position of the cradle 26 may be adjusted about the longitudinal axis of the first rail 22 by adjusting the position of the second rail 24 relative to the arm 36 in addition to, or as an alternative to adjusting the length of the arm 36.

Figure 4:
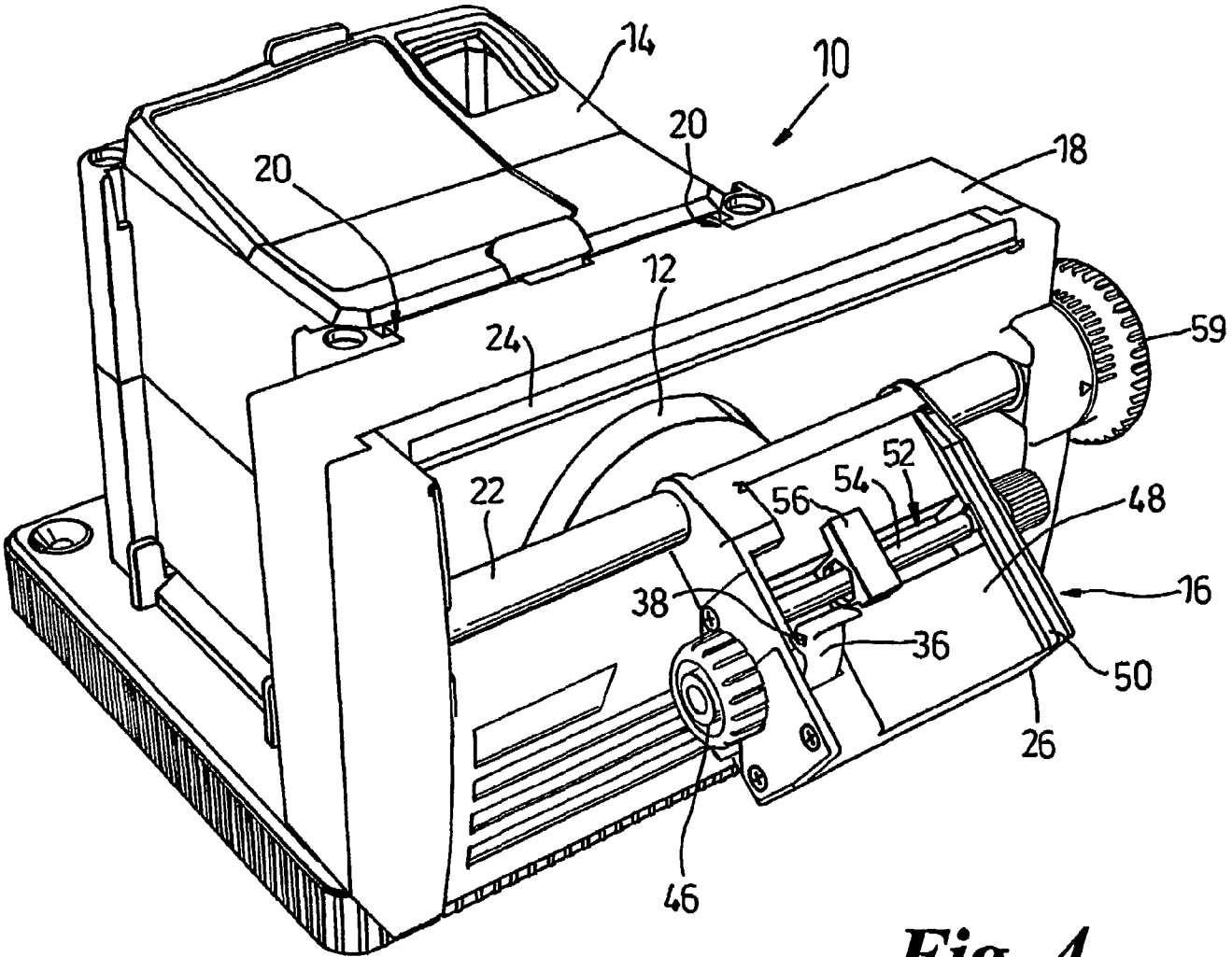
FIG. 4 is a perspective view of the sharpening apparatus of FIG. 1 when the cradle is detached from the second guide rail.

The arm 36 is preferably shaped to form a curved member. The curvature of the arm 36 provides a certain degree of resilience thereby providing a bias that helps to maintain the recess 38 in engagement with the second rail 24. The resilience however may permit a user to disengage the arm 36 from the second rail 24, when required, in order to reveal a blade seat 48, as shown in FIG. 4.

The cradle 26 includes a seat 48 for holding a blade-like implement to be sharpened against a fixed edge 50 extending generally perpendicular to the longitudinal direction of the rectilinear path.

The seat 48 preferably includes a channel 52 formed therein that extends generally parallel to the longitudinal direction of the rectilinear path and has a rail 54 provided therein extending along the length thereof.

A movable block 56 is slidably mounted on the rail 54.

In use, the mounting body 18 is mounted on the housing 14 of the sharpening device 10 such that the rectilinear path defined by the rails 22,24 extends across an exposed face of the grinding wheel 12.

When a blade-like implement is positioned on the seat 48 with its cutting edge facing the first rail 22, the movable block provides an adjustable means for holding the blade-like implement against the fixed edge 50 such that the cutting edge is located parallel to the rectilinear path.

The adjustable mounting of the first rail 22 provides means for adjusting the lateral position of the rectilinear path, and thereby provides means for adjusting the lateral position of the cutting edge of the blade-like implement, in use, relative to the grinding wheel 12.

The adjustable mounting of the cradle 26 relative to the second rail 24 provides means for adjusting the angular position of the cradle 26 about the longitudinal axis $P_a$ of the first rail 22. This in turn enables the angle of the inclined face of the cutting edge of the blade-like implement to be adjusted relative to the rectilinear path and thereby adjusted relative to the grinding wheel 12.

The slidable mounting of the cradle 26 on the first and second rails 22,24 permits sliding movement of the cutting edge of the blade-like implement along the rectilinear path. It thereby permits sliding movement of the cutting edge, in use, relative to the grinding wheel 12.

The provision of a detachable arm 36, permitting disengagement of the cradle 26 from the second rail 24, enables a user to inspect the cutting edge of the blade-like implement during the sharpening process.

The invention claimed is:

1. A sharpening apparatus for a blade-like cutting implement having an elongate body and a cutting edge extending widthwise across one end of the body at a predetermined angle relative to the longitudinal axis of the body, the cutting edge being formed by an inclined face formed on one side face of the body, the apparatus including a cradle for holding a blade-like implement to be sharpened and a mounting body for mounting the cradle relative to a grinding surface, the cradle being mounted on a pair of guide rails for movement along a rectilinear path, the cradle including first and second rail followers slidably connected to a first and second of the guide rails respectively, the cradle including a seat for locating the blade-like implement at a preselected reference position on the cradle such that the cutting edge of the implement to be sharpened is located parallel to said rectilinear path, the first rail movably mounted on the mounting body to enable the lateral position of the rectilinear path to be adjusted when the apparatus is in use, each end of the first rail being mounted on an eccentric rotatably supported in the mounting body such that adjustment of the lateral position of the rectilinear path is achieved by rotation of the eccentrics.

2. Apparatus according to claim 1 wherein parts selected from the group consisting of the second rail, the second rail follower or both are adjustably mounted to enable the angular position of the cradle to be adjusted about the longitudinal axis of the first rail to enable the angle of the inclined face of the implement to be adjusted relative to the rectilinear path.

3. Apparatus according to claim 2 wherein the second rail follower is mounted on an arm slidably received on the cradle and a drive system provided for moving the arm longitudinally relative to the cradle.

4. Apparatus according to claim 1 wherein the cradle is detachable from the second rail to permit the cradle to pivot about the first rail for inspection of the implement during the sharpening process.

5. Apparatus according to claim 4 wherein parts selected from the group consisting of the second rail, the second rail follower or both are adjustably mounted to enable the angular position of the cradle to be adjusted about the longitudinal axis of the first rail to enable the angle of the inclined face of the implement to be adjusted relative to the rectilinear path.

6. Apparatusaccording to claim 5 wherein the second rail follower is mounted on an arm slidably received on the cradle and a drive system provided for moving the arm longitudinally relative to the cradle.

7. Apparatus according to claim 4 wherein the second rail follower is mounted on an arm slidably received on the cradle and a drive system provided for moving the arm longitudinally relative to the cradle.

8. Apparatus according to claim 6 wherein the cradle is detachable from the second rail to permit the cradle to pivot about the first rail for inspection of the implement during the sharpening process.

* * * * *